US006369373B1

(12) United States Patent
Tepera et al.

(10) Patent No.: US 6,369,373 B1
(45) Date of Patent: Apr. 9, 2002

(54) RAMMING BRAKE FOR GUN-LAUNCHED PROJECTILES

(75) Inventors: Joseph E. Tepera, Lindsay; James A. Henderson, Duncanville; G. Michael Liggett, Allen, all of TX (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/442,867

(22) Filed: Nov. 18, 1999

Related U.S. Application Data

(60) Provisional application No. 60/141,449, filed on Jun. 29, 1999.

(51) Int. Cl.[7] ..... F42B 10/00; F42B 10/14; F42B 10/48; F42B 15/01; F41A 15/00; F41A 9/00; F41A 9/39

(52) U.S. Cl. ..... 244/3.3; 89/47

(58) Field of Search ..... 89/47, 33.05; 102/501, 102/532, 520, 372, 373, 374; 244/3.24, 3.3

(56) References Cited

U.S. PATENT DOCUMENTS

| | | | | |
|---|---|---|---|---|
| 910,935 A | | 1/1909 | Meyer | |
| 1,861,522 A | | 6/1932 | Brandt | |
| 2,454,801 A | | 11/1948 | Himmer | 102/93 |
| 2,699,094 A | | 1/1955 | Musser | 89/1.7 |
| 3,687,079 A | | 8/1972 | Scollins | 102/49.2 |
| 3,760,736 A | | 9/1973 | Eig | 102/93 |
| 3,786,760 A | | 1/1974 | Feldmann | 102/93 |
| 3,910,194 A | | 10/1975 | Dehm et al. | 102/93 |
| 4,366,015 A | | 12/1982 | Murray | 156/185 |
| 4,520,731 A | | 6/1985 | Götz et al. | 102/527 |
| 4,552,071 A | | 11/1985 | Horais et al. | 102/527 |
| 4,574,703 A | * | 3/1986 | Halverson | 102/520 |
| 4,833,995 A | | 5/1989 | Götz et al. | 102/521 |
| 4,907,513 A | | 3/1990 | Manion et al. | 102/527 |
| 5,081,931 A | | 1/1992 | Frye et al. | 102/489 |
| 5,160,800 A | * | 11/1992 | Travor et al. | 102/532 |
| 5,165,041 A | * | 11/1992 | Bjerke et al. | 102/520 |
| 5,503,080 A | * | 4/1996 | Goward et al. | 102/293 |

FOREIGN PATENT DOCUMENTS

| | | | | |
|---|---|---|---|---|
| DE | 37 31 034 A1 | | 3/1990 | F42B/14/00 |
| DE | 39 04 626 A1 | | 8/1990 | F42B/14/06 |
| DE | 37 30 359 A1 | | 1/1992 | F42B/14/06 |
| EP | 0 651 224 A1 | | 5/1995 | F41F/3/052 |
| FR | 815222 | | 7/1937 | |
| GB | 2243901 A | * | 11/1991 | F42B/14/06 |
| JP | 404198697 A1 | | 7/1992 | 102/526 |

OTHER PUBLICATIONS

PCT International Search Report dated Mar. 14, 2001 for PCT/US 00/17302 filed Jul. 22, 2000.

Soper, William G., "Spin–Decoupled Projectiles: Relationship of Spin to Muzzle Velocity", Journal of Engineering for Industry, Technical Briefs, vol. 98, No. 1, Feb. 1976, pp. 381–382, XP–002152009.

PCT International Search Report dated Nov. 22, 2000 for PCT/US00/17408 filed Jun. 22, 2000.

* cited by examiner

*Primary Examiner*—Charles T. Jordan
*Assistant Examiner*—Christian M. Best
(74) *Attorney, Agent, or Firm*—Baker Botts L.L.P.

(57) ABSTRACT

A ramming brake is provided for use with a projectile launched from the barrel of a gun having a tapered portion. The ramming brake includes a braking ring that has a tapered surface configured to wedge into a tapered portion of the gun barrel. In a particular configuration, the braking ring wedges in the tapered breach of the gun barrel. The ramming brake further includes a retaining mechanism that is used to couple the braking ring to the projectile. This retaining mechanism restrains and controls the movement of the projectile after the braking ring wedges into the tapered portion of the barrel.

19 Claims, 4 Drawing Sheets

RAMMING BRAKE FOR GUN-LAUNCHED PROJECTILES

RELATED APPLICATIONS

This application claims the benefit of U.S. provisional application Ser. No. 60/141,449, filed Jun. 29, 1999, entitled "RAMMING BRAKE FOR GUN-LAUNCHED PROJECTILE".

TECHNICAL FIELD OF THE INVENTION

This invention relates to projectiles launched from a gun barrel or cannon, and more particularly to a ramming brake for gun-launched projectiles.

BACKGROUND OF THE INVENTION

When launching projectiles out of large military guns or cannons, a typical loading technique is to first ram the projectile into the breach of the gun, and then to ram a propelling charge in a shell casing behind the projectile. The propelling charge is typically positioned in the breach by a shell casing rim that is similar to the rim on a bullet cartridge used with a handgun. This rim is larger than the diameter of the breach and is prevented from being inserted into the barrel of the gun. Alternatively, the propelling charge and the projectile may be contained in a single unit that is inserted into the breach of the gun.

Projectiles launched from military guns are typically rear obturated. The aft end of the projectile has a protruding ring or flange of material called an obturator or a rotating band. The obturator has a diameter smaller than the diameter of the breach, but larger than the diameter of the bore of the gun barrel. The bore is the section of the barrel that typically contains a series of rifling grooves used to impart a spin on the projectile.

During loading, the projectile is rammed into the breach in a manner similar to putting a bullet in a gun chamber. However, unlike a typical bullet, the projectile does not have a cartridge rim to stop it (only the separate propelling charge has a cartridge rim). Therefore, the aft end or rear obturator is used to stop the projectile once it has traveled an appropriate distance into the barrel. Because the rear obturator has a diameter larger than the bore diameter of the gun, the obturator is stopped during loading of the projectile in an area of the gun barrel where the inside diameter decreases from the breach diameter to the bore diameter. This area of inside diameter change is called the forcing cone. Because the obturator is located at the rear of the projectile, when the obturator stops at the forcing cone, most of the projectile is positioned in the bore of the barrel.

When the propelling charge is ignited, the rear of the projectile is forced into the bore of the gun barrel. The obturator, which has a diameter larger than the bore of the gun, is forced to extrude into the rifling grooves. This extrusion helps to prevent the charge gases created by the ignition of the propelling charge from flowing past the projectile in the rifling grooves. By preventing the charge gases from blowing by the projectile, the obturator causes the charge gases to drive the projectile out of the gun at the optimal velocity. In addition, since the rifling grooves spiral down the barrel, the grooves impart a spin to the projectile to increase flight stability. It should be noted that the term "rotating band" is often used to denote a device that provides obturation (the obstruction of gas flow) as well as imparting a rotation to the projectile. The term "obturator" typically refers to a device that only performs the obturation function.

However, for the purposes of this application, the term "obturator" will be used generically to refer to both rotating bands and obturators.

Advanced projectiles ("smart" projectiles) are capable of being fired from the same guns that are used to fire the standard unguided projectiles described above. An example of an unguided projectile is a standard artillery shell, which is basically a large bullet. On the other hand, advanced projectiles have enhanced features such as electronic guidance and extended range rocket motors. For example, certain advanced projectiles are launched from a gun using a propelling charge, but then use a rocket motor and a guidance system to propel them to a selected target. These advanced projectiles must be designed to be loaded and fired in the same gun barrels that were designed to fire the standard unguided projectiles. However, advanced projectiles are often longer than standard projectiles due to their increased complexity. In addition, in order to increase the range of advanced projectiles, a relatively thin rocket motor wall is used. Because of the increased length and the thin rocket motor wall, if a standard rear obturator is used on such projectiles, the launch pressures created when the charge is ignited would buckle the aft portion of the advanced projectile.

An obturator or related device must be used in order to stop the charge gases from blowing by the projectile. This function is important in the case of advanced projectiles due to the sensitivity of the guidance electronics. Any blow-by could potentially destroy the projectile's operability. Additionally, a brake is needed to stop the projectile when it is rammed into the gun. Traditionally, both of these functions have been performed by the rear obturator or rotating band, as described above. However, since the obturator cannot be located at the rear of the projectile on an advanced projectile, the standard rear obturator/rotating band design used with unguided projectiles must be replaced by one or more components that serve the functions of stopping the advanced projectile when rammed into the gun barrel.

SUMMARY OF THE INVENTION

Accordingly, a need has arisen for apparatus to position an advanced projectile in a gun barrel during loading of the projectile. The present invention provides a ramming brake for use with a gun-launched projectile that addresses shortcomings of prior apparatus.

In accordance with the present invention, there is provided a ramming brake for use with a projectile launched from the barrel of a gun having a tapered portion. The ramming brake includes a braking ring that has a tapered surface configured to wedge into a tapered portion of the gun barrel. In a particular configuration, the braking ring wedges in the tapered breach of the gun barrel. The ramming brake further includes a retaining mechanism that is used to couple the braking ring to the projectile. This retaining mechanism restrains and controls the movement of the projectile after the braking ring wedges into the tapered portion of the barrel.

Embodiments of the present invention provide numerous technical advantages. For example, in one embodiment of the invention, a ramming brake is provided that stops the aft end of a mid-body obturated projectile from entering the bore of a gun barrel during loading of the projectile into the barrel. Furthermore, ramming brakes incorporating teachings of the present invention are typically fabricated from a material that disintegrates once the projectile is fired from the gun. Such disintegration prevents the ramming brake from damaging the inside of the gun barrel during launch.

Additional technical advantages include a ramming brake having a configuration that allows the brake to be stopped in the breach of the gun instead of the forcing cone. Because typically unguided munitions are stopped in the forcing cone during loading, this area typically experiences high wear. By providing a ramming brake for use with advanced projectiles that stop in the breach (which experiences little wear) additional wear of the forcing cone is minimized. However, ramming brakes incorporating teachings of the present invention also function when stopped in the forcing cone instead of the breach (which may occur once the inner surface of the gun barrel wears after many uses). Moreover, a ramming brake is provided in one embodiment of the present invention that is not rigidly attached to the projectile. For example, semi-elastic cords are used to attach the braking ring to the projectile. In such instances, the force needed to stop the momentum of the moving projectile is greatly decreased.

Other technical advantages are readily apparent to one skilled in the art from the following figures, descriptions, and claims.

BRIEF DESCRIPTION OF THE DRAWINGS

For a more complete understanding of the present invention and the advantages thereof, reference is now made to the following descriptions taken in connection with the accompanying drawings in which.

DETAILED DESCRIPTION OF THE INVENTION

Embodiments of the present invention and its advantages are best understood by referring to FIGS. 1 through 7 of the drawings, like numerals being used for like and corresponding parts of the various drawings.

Figure 1:
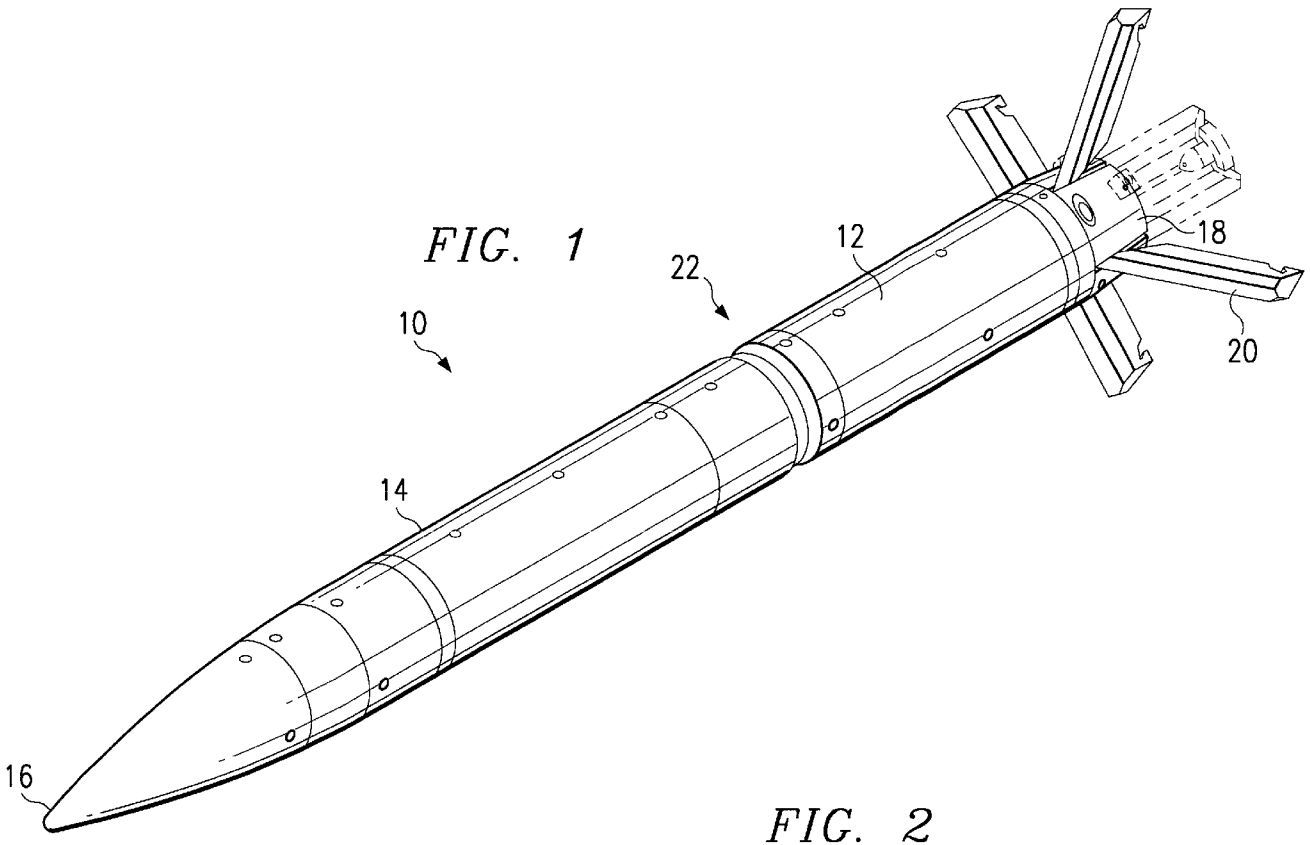
FIG. 1 is an illustration of a gun-launched projectile for use in conjunction with the present invention.

FIG. 1 illustrates a gun-launched projectile for use in conjunction with the present invention. The projectile 10 is an advanced or "smart" projectile that is fired from a gun that traditionally fires standard unguided projectiles. Examples of such guns are large naval and artillery guns. Projectile 10 includes a propulsion segment 12; typically a solid rocket motor. Once projectile 10 is fired from a gun, propulsion segment 12 ignites to accelerate the projectile to the desired velocity. Projectile 10 also includes a payload segment 14. Payload segment 14 includes the non-propulsion systems of the projectile. For example, payload segment 14 typically includes a plurality of sub-munitions or some other explosive device or devices. Payload segment 14 also typically includes an electronics package for controlling the guidance of the projectile 10. Projectile 10 has a tip 16 at its forward end and an aft closure 18 at its aft end. Further, the projectile includes a plurality of fins 20 used to guide and stabilize the projectile (although not explicitly shown, fins may also be disposed around payload segment 14). In addition, projectile 10 includes an obturator seat 22. Obturator seat 22 functions to position an obturator (not explicitly shown in FIG. 1). The function of the obturator and obturator seat 22 will described below.

Due to the length and thin rocket motor walls of advanced projectiles, a traditional rear obturator, as used on shorter, unguided projectiles that are fired from the same type of gun, cannot be used. If projectile 10 was rear obturated (meaning that the obturator is positioned at or in close proximity to the aft end of the projectile), the forces placed on the projectile when launched from the gun would cause propulsion segment 12 to buckle. The structure of propulsion segment 12 cannot be augmented to overcome this problem because too much weight would be added to the projectile (which would reduce the projectile's range and/or payload capacity).

However, if the obturator is moved near the middle of projectile 10 to a "mid-body" position, the launch forces applied to propulsion segment 12 are reduced. This is due to the fact that payload segment 14 (or any structure that is forward of the obturator) bears part of the load, while propulsion segment 12 (or any structure aft of the obturator) bears the other part. In addition, the forces that are applied to propulsion segment 12 are generally tensile when a "mid-body" obturator is used. When a rear obturator is used, the forces on propulsion segment 12 are generally compressive. Due to the reduction of launch forces and the fact that the tensile strength of propulsion segment 12 is typically better than its compressive strength, a "mid-body" obturator is superior to a rear obturator for use with advanced projectiles such as projectile 10.

For the reasons described above, obturator seat 22 is generally located near the middle of projectile 10. However, there is no strict requirement that the obturator be located at the exact center of projectile 10. All that is required is that the obturator be positioned at substantially a mid-body location to lower the launch forces applied to propulsion segment 12. As will be discussed below, this generally means that the obturator, and thus obturator seat 22, is located at a point along projectile 10 that will be loaded into the bore of the gun barrel. For this reason, the obturator cannot have a larger outer diameter than the bore of the barrel.

Figure 2:
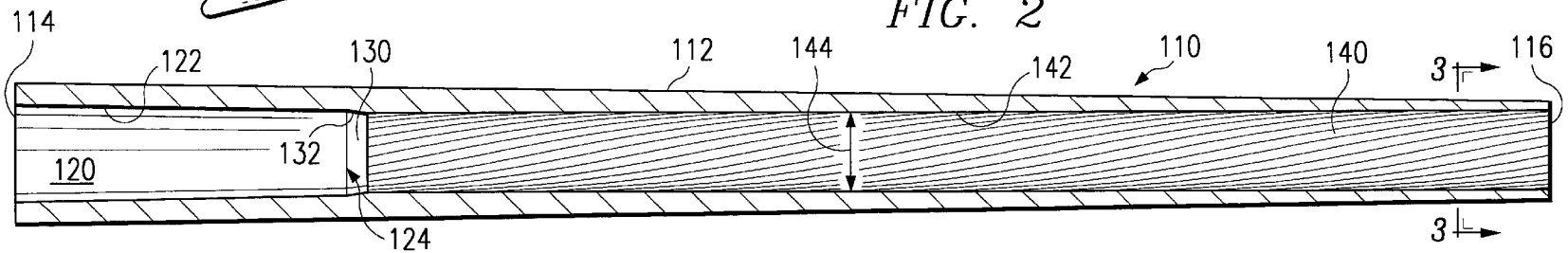
FIG. 2 is a cross-section illustrating a gun barrel for launching the projectile of FIG. 1.
Figure 3:
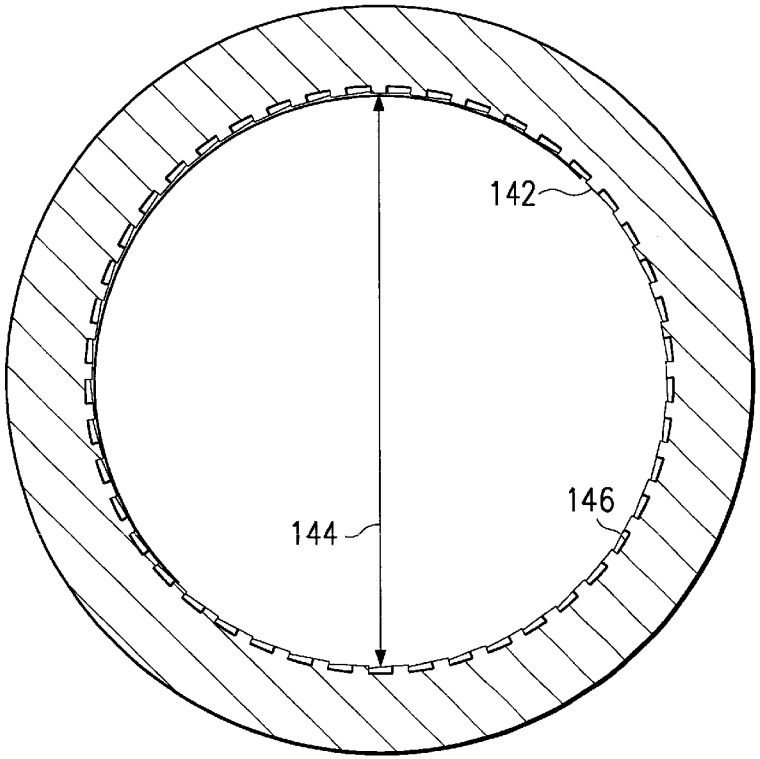
FIG. 3 is a cross-section of the gun barrel of FIG. 2, taken along line 3—3.

In order to further explain the configuration of the obturator and obturator seat 22, reference is now made to FIGS. 2 and 3. FIG. 2 is an illustration of a gun barrel for typically launching projectile 10. Barrel 110 includes three primary sections: a breach 120, a forcing cone 130, and a bore 140. Barrel 110 has three distinct inner surfaces corresponding to these sections. An inner surface 122 of breach 120 tapers slightly inward from an aft end 114 to a forward end 124 of breach 120. An inner surface 142 of bore 140 is of a uniform bore diameter 144 throughout the length of bore 140. The diameter of the breach at its forward end 124 is larger than bore diameter 144. Thus, an inner surface 132 of forcing cone 130 forms a tapered cone that connects inner surface 122 of breach 120 to inner surface 142 of bore 140.

FIG. 3 illustrates a cross-section of bore 140 of FIG. 2, taken along line 3-3. Bore 140 contains a plurality of rifling grooves 146 formed in inner surface 142. Rifling grooves 146 generally begin at the point where forcing cone 130 ends and where bore 140 begins. Each rifling groove spirals along bore 140 at a constant angle until it reaches a forward end 116 of barrel 110. Rifling grooves 146 rotate a projectile after the charge has been fired and the projectile travels along bore 140. Such rotation is needed to give unguided projectiles stability in flight.

Referring now to FIGS. 2 and 3, when a rear obturated projectile is loaded into barrel 110, the projectile is first inserted into breach 120. The projectile has a diameter less than, but substantially equal to bore diameter 144. Therefore, the projectile will travel along barrel 110 and into bore 140 until the obturator reaches forcing cone 130. A typical rear obturator has an outside diameter that is smaller than the diameter of breach 120 at its forward end 124, but larger than bore diameter 144. Therefore, when the obturator enters forcing cone 130, the obturator will come into full contact with inner surface 132 at a point where the inside diameter of forcing cone 130 generally equals the outside diameter of the obturator. At this point, the rear obturator is prevented from moving forward, thus stopping the projectile. Therefore, the first function of the rear obturator is to act as a ramming brake to prevent the projectile from completely entering bore 140.

Once the projectile has been stopped, a propelling charge is inserted into breach 120 behind the projectile. The projectile is then fired by igniting the propelling charge. A rear obturator is typically made of metal, such as copper or gilding metal. A rear obturator may also be fabricated from suitable non-metallic materials, such as thermosets or thermoplastics. The flow of charge gases created by the ignition of the propelling charge creates enough force to deform the rear obturator and force the aft end of the projectile into bore 140. As the obturator is forced into bore 140, it is extruded into rifling grooves 146 in bore 140. The obturator serves two other functions at this point. The first function is to impart a spin to the projectile by following the spiraling configuration of rifling grooves 146 as the projectile travels along bore 140. The other function is to provide a seal between the body of the projectile and the inner surface of the gun so that the charge gases are obstructed from flowing past the projectile (between the projectile and inner surface 142 of bore 140 or in rifling grooves 146).

Referring now to FIGS. 1, 2 and 3 in combination, as described above, a rear obturator cannot be used with projectile 10. Instead, a "mid-body" obturator is utilized to minimize the charge gases from traveling between the projectile and inner surface 142 of bore 140 or in rifling grooves 146. However, when the projectile is loaded into barrel 110, most of the projectile, including the obturator seat 22 is positioned in bore 140 to enable loading of the propelling charge in breach 120. Therefore, the obturator generally cannot have an outer diameter larger than bore diameter 144. Because the outer diameter of the obturator is less than or substantially equal to bore diameter 144, the mid-body obturator cannot be utilized as a ramming brake during loading. Therefore, when a mid-body obturator is used for sealing the rifling grooves 146 during firing, an additional, discrete ramming brake is required to perform the function of positioning the projectile during ramming.

Figure 5:
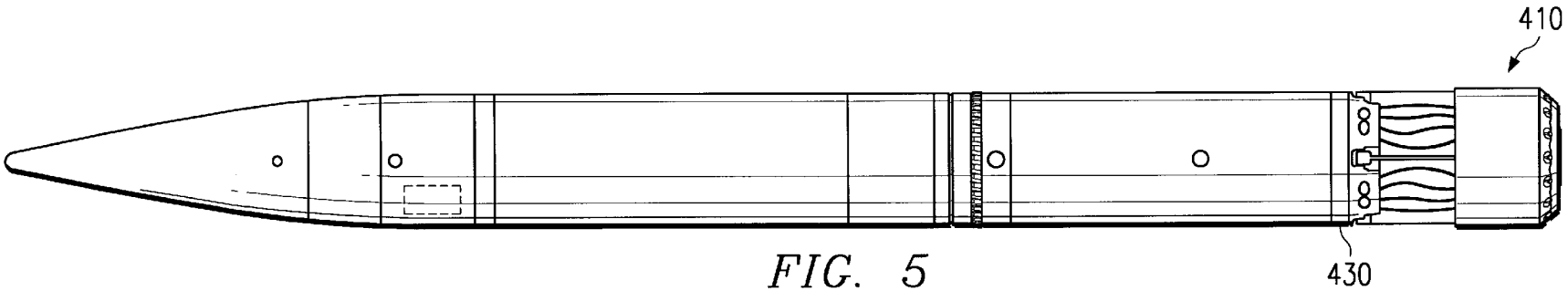
FIG. 5 is a drawing illustrating the ramming brake of FIG. 4 mounted on an associated projectile.
Figure 4:
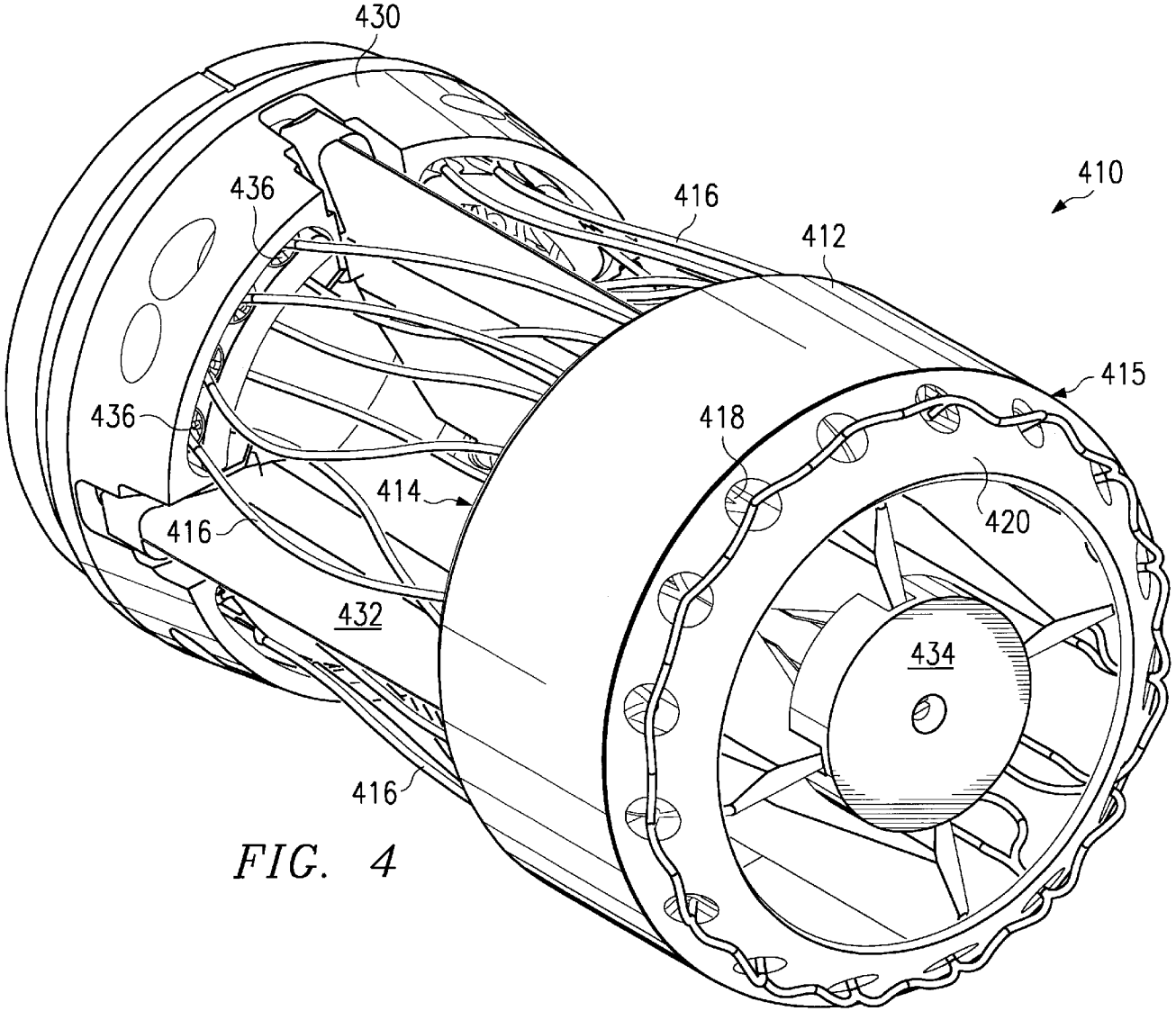
FIG. 4 is an illustration of a ramming brake incorporating teachings of the present invention.

Referring now to FIG. 4, there is shown an illustration of one embodiment of a ramming brake 410 incorporating teachings of the present invention. Ramming brake 410 is utilized with a mid-body obturated projectile, like projectile 10 of FIG. 1. Preferably the ramming brake 410 is coupled to an aft closure 430 of the projectile being rammed. FIG. 5 illustrates one such method of attaching ramming brake 410 to a projectile. A set of tail fins 432 are attached to aft closure 430. In order to load the projectile into the gun, tail fins 432 are folded down behind aft closure 430. Tail fins 432 are held in this folded position during loading and firing by a fin retaining plate 434.

In order to properly position the projectile in the gun to allow room for the propelling charge, it is preferable that ramming brake 410 be located at the aft end of the projectile. However, since the projectile as loaded has folded tail fins 432, the "end" of the of the projectile is the tail fins. Therefore, ramming brake 410 is positioned behind aft closure 430 and around folded tail fins 432.

Ramming brake 410 includes a braking ring 412 that has a hollow, generally cylindrical shape with an inner diameter sufficiently large to contain folded fins 432. In addition, the hollow shape of braking ring 412 enables the charge gases to pass through ramming brake 410 when the projectile is fired. If the charge gases cannot pass through ramming brake, then the ramming brake acts as a rear obturator, and the advantages of using a mid-body obturator are frustrated.

Braking ring 412 is slightly tapered to form a conical shape having an outer diameter that is slightly smaller at a forward end 414 than at an aft end 415. The taper of braking ring 412 generally conforms to and fits with the taper in the breach of the gun just before the forcing cone. Therefore, when the projectile is loaded into the gun barrel, braking ring 412 wedges into and stops in this tapered area. In addition, braking ring 412 may be configured to wedge into other portions of the gun barrel, such as the forcing cone. However, the forcing cone experiences the greatest amount of wear of any part of the gun barrel, and thus it is advantageous to use a braking ring 412 configured to wedge into other portions of the gun barrel. In general, braking ring 412, and the other braking rings described below, may wedge into any tapered portion of the barrel, including the tapered breach and the forcing cone. In addition to properly positioning the projectile (which is discussed below), the wedging of the ramming brake 410 into the gun barrel provides sufficient frictional force to retain the projectile in its proper position when the gun barrel is elevated or depressed at high angles (or when other forces are applied to the projectile, such as impacts from the transportation of the gun over rough seas or terrain).

A projectile is typically rammed into the gun barrel at speeds of seventeen to twenty feet per second. In order to properly position the projectile, it is preferable to stop the projectile within an inch of its desired position. If the ramming brake is rigidly attached to the projectile, the effective force that the ramming brake must stop is much greater than the force that must be stopped when the ramming brake is not rigidly attached to the projectile. Therefore, instead of being rigidly attached to the projectile, braking ring 412 is coupled to aft closure 430 through a retaining system that includes a plurality of semi-elastic cords or laces 416. When the projectile is rammed into the barrel 110, and ramming brake 412 stops in the breach 120, some percentage of cords 416 may stretch with varying degrees of elasticity, and some may stretch inelastically. Some cords 416 may even break. The accumulated effect of these different responses acts to absorb much of the force created during braking and to correctly position the projectile for firing by pulling the projectile slightly backwards in the barrel after cords 416 have stretched due to the braking forces. The terms 'semi-elastic' and 'semi-elastically' are used in this application to describe this effect.

Cords 416 are preferably fabricated from aramid fibers (sold under the trademark KEVLAR), however, other suitable materials such as nylon, polyester or polyethylene may be used. In addition to providing elasticity, cords 416 allow ramming brake 412 to be positioned behind aft closure 430 and around fins 432, but still be attached to aft closure 430. Cords 416 are preferably laced between a plurality of apertures 436 in aft closure 430 and a plurality of apertures 418 in a lacing flange 420 of ramming brake 410. Lacing flange 420 is a conical flange that extends inwardly from aft end 415 of braking ring 412, and is formed integral with the braking ring. Lacing flange 420 is angled inward to provide a surface against which cords 416 can be laced to couple ramming brake 410 to aft closure 430. The number of apertures 418, 436 and the method of lacing may be varied without departing from the scope of the present invention. For example, a single cord may be laced through every aperture 418, 436, or a series of cords may each be laced between discrete groups of apertures 418, 436. In addition, any other suitable retaining mechanisms for coupling ramming brake 410 to aft closure 430 may also be used.

Because ramming brake 410 is positioned around fins 432, in order for fins 432 to open after launch, ramming brake 410 must be separated from the projectile once the projectile is fired. In addition, it is preferable that ramming brake 410 disintegrate during firing so as not to produce excessive wear inside the gun barrel, and not endanger personnel and objects located near the gun. Therefore, ramming brake 410 is typically made from a material(s) that is frangible under firing forces created by the propelling charge, but that is strong enough to stop the projectile under ramming forces. In addition, the material(s) used must be able to withstand high temperatures in the gun barrel created by the repeated firing of the gun. The material must be able to withstand these high temperatures for a sufficient period of time to allow the projectile to be loaded and fired. Preferably, the material used to fabricate ramming brake 410 is a graphite composite material. For example, one embodiment of the present invention utilizes a wound carbon-graphite filament to reinforce a thermoset resin, such as epoxy. However, other suitable materials, such as cyanate ester, polyester, and bismaleimide, may be used without departing from the scope of the present invention.

Figure 6:
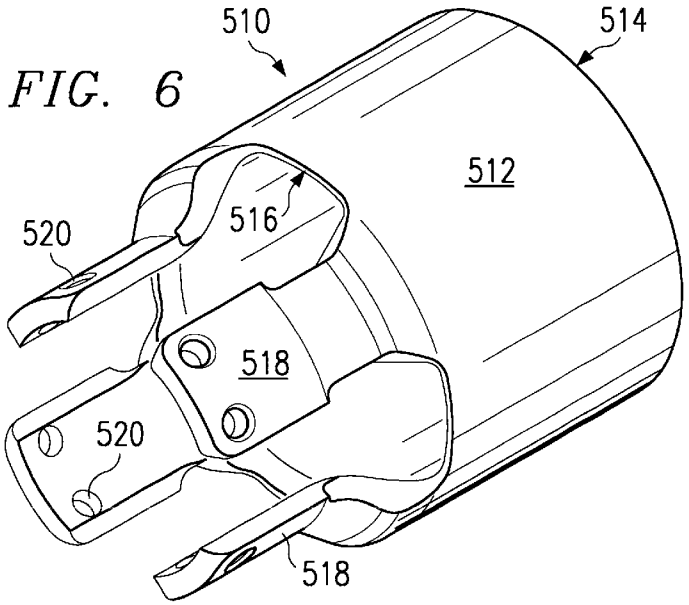
FIG. 6 is an illustration of an alternate configuration of a ramming brake incorporating teachings of the present invention.

FIG. 6 illustrates a second embodiment of a ramming brake 510 incorporating teachings of the present invention. As with ramming brake 410, ramming brake 510 is operable for use with a mid-body obturated projectile. Ramming brake 510 includes a braking ring 512. As with braking ring 412 of ramming brake 410, braking ring 512 has a slightly tapered conical shape. The outside diameter of braking ring 512 is slightly larger at an aft end 514 than at a forward end 516. As with braking ring 412, the conical shape of braking ring 512 is configured to conform with the taper in the breach of the gun barrel just before the forcing cone. Therefore, braking ring 512 wedges into and stops in this tapered area when the projectile is rammed. However, as with braking ring 412, braking ring 512 may be configured to conform with other portions of the gun barrel.

Unlike ramming brake 410, ramming brake 510 does not use a retaining mechanism that semi-elastically attaches braking ring 512 to the associated projectile. Instead, ramming brake 510 uses a retaining mechanism that includes a number of generally rigid mounting arms 518 that extend from forward end 516 of braking ring 512. The outer diameter defined by mounting arms 518 is smaller than the outer diameter of braking ring 512. Thus, mounting arms 518 do not contact the gun barrel during loading. Finally, mounting arms 518 each include a pair of mounting holes 520 used to attach ramming brake 510 to a projectile. It will be understood that the number of mounting arms 518 and the number of mounting holes 520 may be varied without departing from the scope of the present invention. In addition, mounting arms 518 may either be formed integral with braking ring 512, or later attached to braking ring 512 using an appropriate fastening method.

Figure 7:
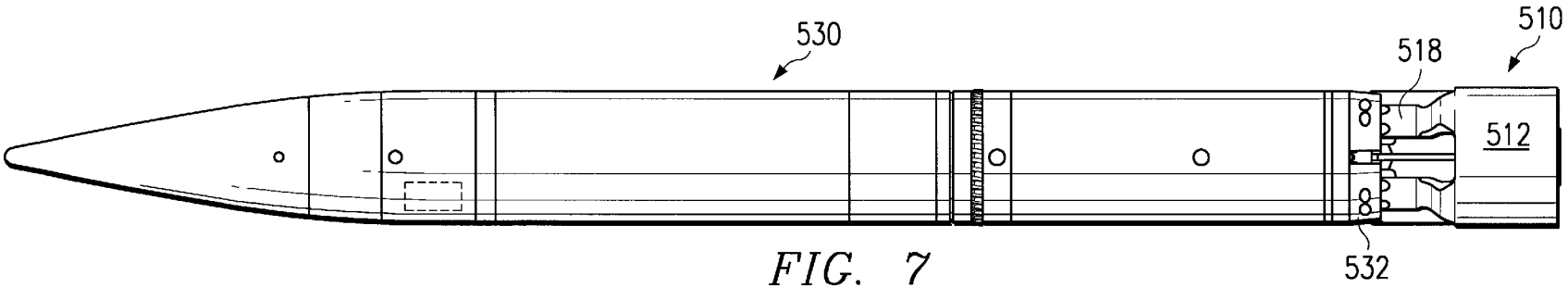
FIG. 7 is a drawing illustrating the ramming brake of FIG. 6 mounted on an associated projectile.

As with braking ring 412 of ramming brake 410, braking ring 512 has an inside diameter that is sufficiently large to accommodate the folded fins of the projectile. Ramming brake 510 is slipped over the folded fins of the projectile, with mounting arms 518 facing forward, until mounting holes 520 are aligned with a set of corresponding mounting holes located on the aft closure of the projectile. A fastening member, such as a bolt or screw, is then placed through the mounting holes of the projectile and mounting holes 518 of ramming brake 510 in order to secure brake 510 to the projectile. FIG. 7 illustrates ramming brake 510 mounted on an aft closure 532 of a projectile 530.

The materials for fabrication of the ramming brake 510 must meet the same requirements described above in conjunction with ramming brake 410. Preferably, the material used to fabricate ramming brake 510 is a graphite composite material. For example, one embodiment of the present invention utilizes a wound carbon-graphite filament to reinforce a thermoset resin, such as epoxy. However, other suitable materials, such as cyanate ester, polyester, and bismaleimide, may be used without departing from the scope of the present invention.

Although the present invention and its advantages have been described in detail, it should be understood that various changes, substitutions, and alterations can be made therein without departing from the spirit and scope of the present invention as defined by the appended claims.

What is claimed is:

1. A ramming brake for use with a mid-body obturated projectile launched from the barrel of a gun, the barrel having a tapered portion, comprising:

a braking ring having a surface configured to wedge into the tapered portion of the gun barrel, wherein the braking ring comprises a frangible material that disintegrates during the launch of the projectile from the barrel; and a retaining mechanism configured to non-rigidly couple the braking ring to the mid-body obturated projectile, the retaining mechanism restraining the movement of the projectile after the braking ring wedges in the tapered portion.

2. The ramming brake of claim 1, wherein the surface of the braking ring has a tapered configuration to wedge into a tapered breach of the barrel.

3. The ramming brake of claim 1, wherein the braking ring comprises a carbon-graphite filament composite material.

4. The ramming brake of claim 1, wherein the braking ring comprises a configuration for positioning around a set of folded fins of the projectile.

5. The ramming brake of claim 1, wherein the retaining mechanism comprises at least one semi-elastic cord coupling the projectile to the braking ring.

6. The ramming brake of claim 5, wherein the at least one semi-elastic cord comprises a material selected from the group consisting of aramid, nylon, polyester and polyethylene fibers.

7. The ramming brake of claim 5, further comprising a lacing flange extending inwardly from an aft end of the braking ring, the lacing flange having at least one aperture for lacing the at least one semi-elastic cord to couple the braking ring to the projectile.

8. The ramming brake of claim 1, wherein the retaining mechanism comprises at least one mounting leg coupling the projectile to the braking ring.

9. A raining brake for use with a projectile launched from the barrel of a gun, the barrel having a tapered breach, comprising:

a braking ring having a surface configured to wedge into the tapered breach, a conical lacing flange attached to and extending inwardly from an aft end of the braking ring; and a retaining mechanism configured to couple the lacing flange to the projectile, the retaining mechanism restraining the movement of the projectile after the braking ring wedges in the tapered breach.

10. The ramming brake of claim 9, wherein the braking ring comprises a carbon-graphite filament composite material.

11. The ramming brake of claim 9, wherein the retaining mechanism comprises at least one semi-elastic cord coupling the lacing flange to the projectile.

12. The ramming brake of claim 11, wherein the at least one semi-elastic cord comprises a material selected from the group consisting of aramid, nylon, polyester and polyethylene fibers.

13. The ramming brake of claim 9, wherein:

the lacing flange includes a plurality of apertures circumferentially spaced around the flange, and the retaining mechanism comprises at least one semi-elastic cord laced through the apertures of the lacing flange.

14. A ramming brake for use with a mid-body obturated projectile launched from the barrel of a gum, the barrel having a tapered portion, comprising:

a braking ring having a surface configured to wedge into the tapered portion of the gun barrel; and at least one non-rigid mounting leg as an integral part of the braking ring and configured to couple the braking ring to the mid-body obturated projectile, the at least one mounting leg restraining the movement of the projectile after tie braking ring wedges in the tapered portion of the barrel.

15. The ramming brake of claim 14, wherein the surface of the braking ring comprise a tapered configuration to wedge into at tapered breach of the barrel.

16. The ramming brake of claim 14, wherein the braking ring comprises a carbon-graphite filament composite material.

17. The ramming brake of claim 14, wherein the braking ring and mounting leg comprise a carbon-graphite filament composite material.

18. The ramming brake as set forth in claim 14, wherein the braking ring comprises a frangible material that disintegrates during launch of the projectile from the barrel.

19. The ramming brake of claim 14, wherein the braking ring comprises a configuration for positioning around a set of folded fins of the projectile.

* * * * *

UNITED STATES PATENT AND TRADEMARK OFFICE

CERTIFICATE OF CORRECTION

PATENT NO. : 6,369,373 B1
DATED : April 9, 2002
INVENTOR(S) : Joseph E. Tepera et al.

It is certified that error appears in the above-identified patent and that said Letters Patent is hereby corrected as shown below:

Column 4,
Line 10, after “will”, insert -- be --.

Column 6,
Line 9, after “”end””, delete “of the”.

Column 9,
Line 6, delete “raining” and insert -- ramming --.
Line 10, after “breach”, delete “,” and insert -- : --.

Column 10,
Line 3, after “flange”, delete “,” and insert -- ; --.
Line 5, delete “gum” and insert -- gun --.
Line 13, after “after”, delete “tie”, and insert -- the --.
Line 16, delete “comprise” and insert -- comprises --.
Line 17, after “into”, delete “at”, and insert -- a --.

Signed and Sealed this

Thirtieth Day of July, 2002

*Attest:*

*Attesting Officer*

JAMES E. ROGAN
*Director of the United States Patent and Trademark Office*